US005729844A

United States Patent [19]

Kerstetter

[11] Patent Number: 5,729,844

[45] Date of Patent: Mar. 24, 1998

[54] PORTABLE BABY SLEEPING SWING

[76] Inventor: Dawn Ruth Kerstetter, 3455 Street Rd. Apt. Livingston 8, Bensalem, Pa. 19020

[21] Appl. No.: 779,354

[22] Filed: Jan. 6, 1997

[51] Int. Cl.[6] ..... A47D 9/02

[52] U.S. Cl. ..... 5/104; 5/120; 5/123; 297/274; 482/904

[58] Field of Search ..... 5/104, 120, 123, 5/122, 124, 127, 128, 655; 297/274; 472/118, 135; 482/904, 69, 40; 248/317

[56] References Cited

U.S. PATENT DOCUMENTS

| | | | |
|---|---|---|---|
| 483,270 | 9/1892 | Tothill | 297/274 |
| 517,557 | 4/1894 | Thomas | 5/120 |
| 5,097,545 | 3/1992 | Hool | 5/104 |
| 5,288,283 | 2/1994 | Merker | 297/274 |

FOREIGN PATENT DOCUMENTS

| | | | |
|---|---|---|---|
| 600321 | 2/1926 | France | 297/274 |
| 19880 | 8/1997 | United Kingdom | 5/104 |

*Primary Examiner*—Alexander Grosz

[57] ABSTRACT

A portable baby sleeping swing including a door attachment portion adapted for securement to a door jamb. A pair of springs each having upper ends secured to a hook. The hook is secured to the door attachment portion. The lower ends of the springs have a hook disposed therebetween. A hammock is secured to the hook on the lower ends of the pair of springs.

5 Claims, 3 Drawing Sheets

PORTABLE BABY SLEEPING SWING

BACKGROUND OF THE INVENTION

1. Field of the Invention

The present invention relates to a portable baby sleeping swing and more particularly pertains to attaching to a doorway for a baby to sleep in with a portable baby sleeping swing.

2. Description of the Prior Art

The use of child hammocks is known in the prior art. More specifically, child hammocks heretofore devised and utilized for the purpose of supporting and confining a baby are known to consist basically of familiar, expected and obvious structural configurations, notwithstanding the myriad of designs encompassed by the crowded prior art which have been developed for the fulfillment of countless objectives and requirements. By way of example, U.S. Pat. No. 5,274,863 to Fountain discloses a childs hammock.

U.S. Pat. No. 5,097,545 to Hooi discloses a spring supported, hammock type infant cradle.

U.S. Pat. No. 4,550,456 to Alien discloses an infant cradle assembly.

U.S. Pat. No. 5,113,537 to Turk discloses a portable sleeping unit for children.

U.S. Pat. No. 4,375,110 to Murphy discloses a hammock, especially baby hammock.

U.S. Pat. No. Des. 328,828 to Turk discloses the ornamental design for an enclosed hammock.

While these devices fulfill their respective, particular objective and requirements, the aforementioned patents do not describe a portable baby sleeping swing for attaching to a doorway for a baby to sleep in.

In this respect, the portable baby sleeping swing according to the present invention substantially departs from the conventional concepts and designs of the prior art.

Therefore, it can be appreciated that there exists a continuing need for a new and improved portable baby sleeping swing which can be used for attaching to a doorway for a baby to sleep in with a portable baby sleeping swing. In this regard, the present invention substantially fulfills this need.

SUMMARY OF THE INVENTION

In the view of the foregoing disadvantages inherent in the known types of child hammocks now present in the prior art, the present invention provides an improved portable baby sleeping swing. As such, the general purpose of the present invention, which will be described subsequently in greater detail, is to provide a new and improved portable baby sleeping swing and method which has all the advantages of the prior art and none of the disadvantages.

To attain this, the present invention essentially comprises a door attachment portion including a housing having a pair of spring-biased arms extending upwardly from within the housing. Free upper ends of the arms have pads disposed thereon for securement to a door jamb. Lower ends of the arms have a spring disposed therebetween for biasing the free upper ends together. A U-shaped ring extends downwardly from the housing. The U-shaped ring has an upper safety latch disposed thereon. The device includes a pair of springs each having upper ends and lower ends. The upper ends of the springs are secured to a hook. The hook is secured to the upper safety latch of the door attachment portion. The lower ends of the springs have a hook disposed therebetween. The hook has a lower safety latch coupled thereto. The device includes a hammock comprised of a sheet of flexible material. The sheet of flexible material is sewn into a triangular configuration and secured to the lower safety latch of the pair of springs. The sheet of flexible material has a neck roll removably secured to an upper surface thereof. The device includes a separator board comprised of an elongated and planar member. The separator board has a shaft extending upwardly from a central portion thereof. A free end of the shaft has a hook disposed thereon. The hook is securable to the lower safety latch. End portions of the separator board have arcuate recesses formed therein for receiving the sheet of flexible material therewithin. The separator board serves to maintain the sheet of flexible material in an open configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
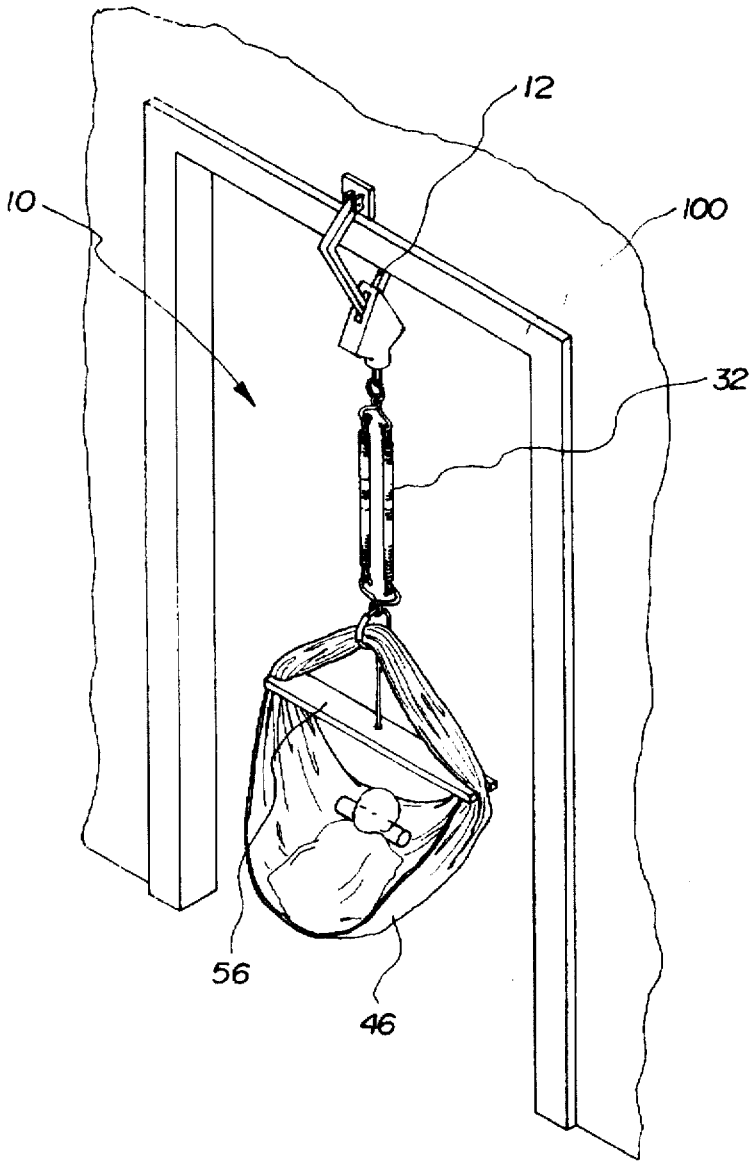
FIG. 1 is a perspective view of the preferred embodiment of the portable baby sleeping swing constructed in accordance with the principles of the present invention.
Figure 2:
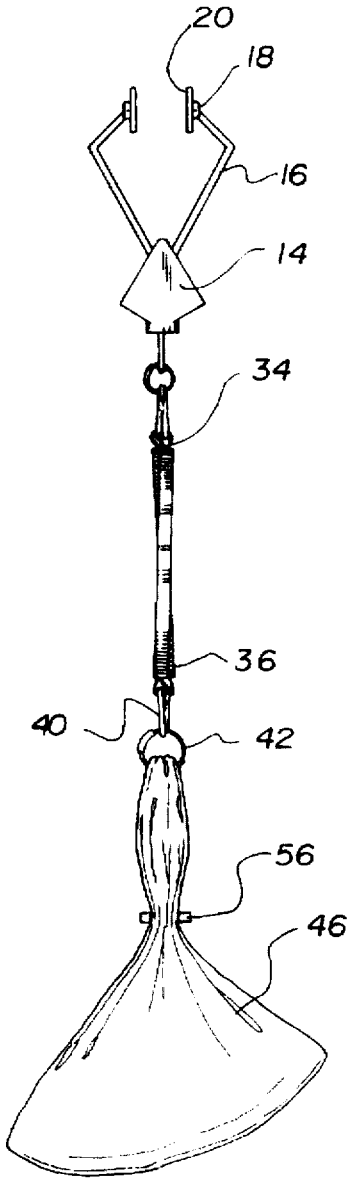
FIG. 2 is a side elevation view of the present invention.
Figure 3:
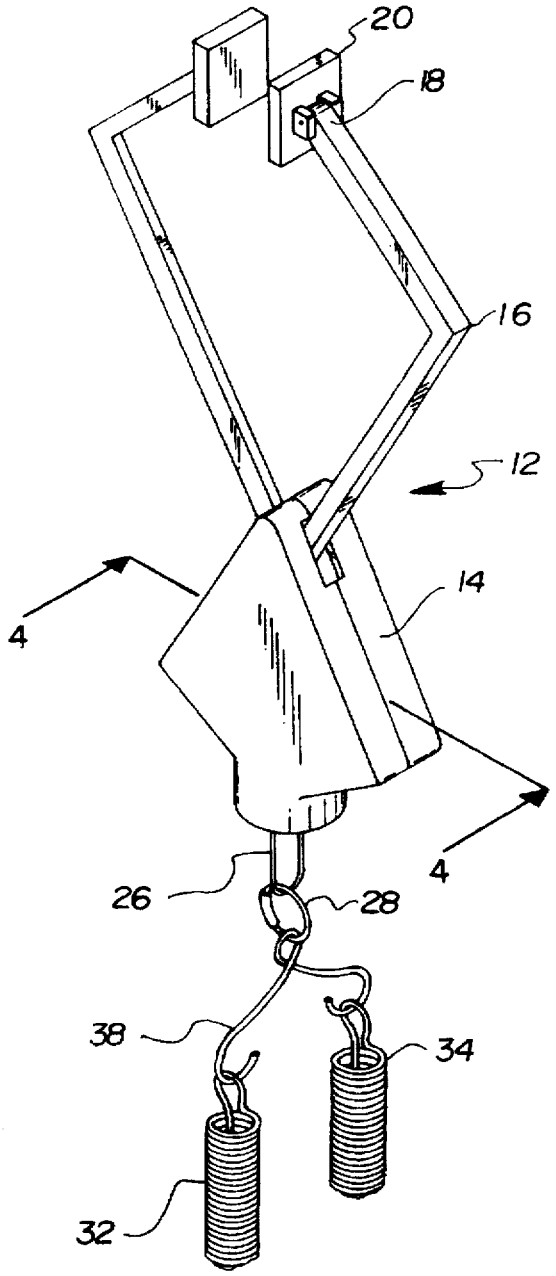
FIG. 3 is a perspective view of an upper portion of the present invention.
Figure 4:
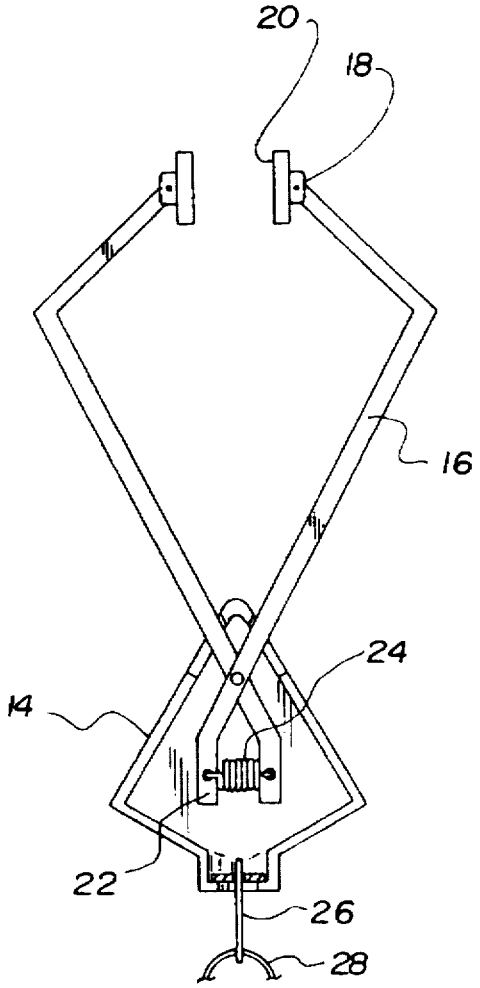
FIG. 4 is a cross-sectional view as taken along line 4—4 of FIG. 3.
Figure 5:
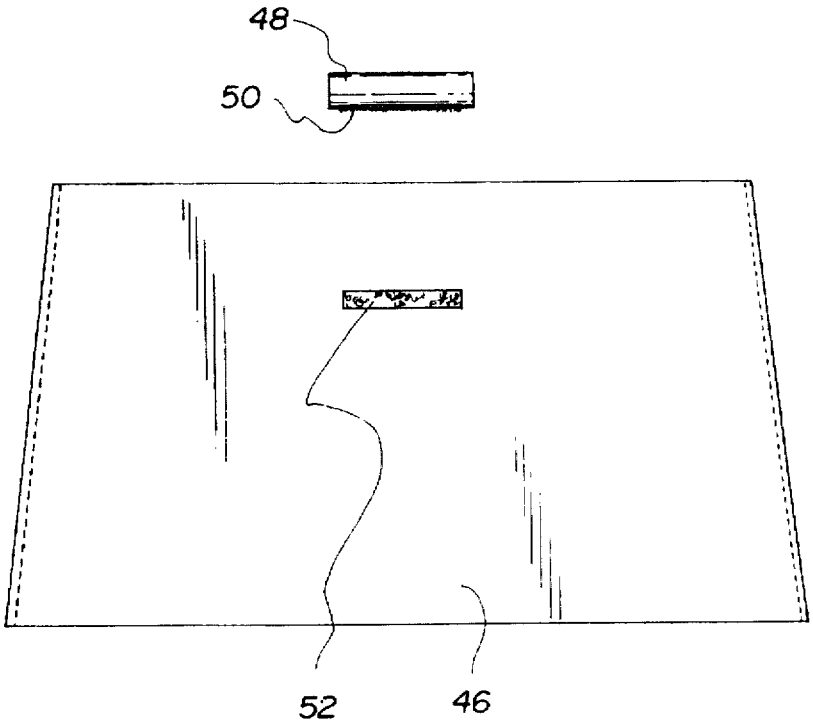
FIG. 5 is a plan view of the bed of the present invention.
Figure 6:
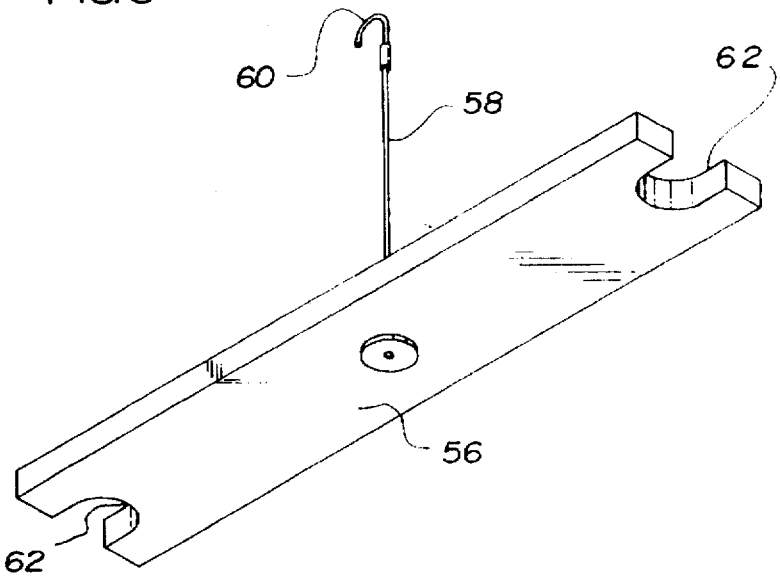
FIG. 6 is a perspective view of the separator board of the present invention.

With reference now to the drawings, and in particular, to FIGS. 1 through 6 thereof, the preferred embodiment of the new and improved portable baby sleeping swing embodying the principles and concepts of the present invention and generally designated by the reference number 10 will be described.

Specifically, it will be noted in the various Figures that the device relates to a portable baby sleeping swing for attaching to a doorway for a baby to sleep in. In its broadest context, the device consists of a door attachment portion, a pair of springs, a hammock and a separator board. Such components are individually configured and correlated with respect to each other so as to attain the desired objective.

The device 10 includes a door attachment portion 12 including a housing 14 having a pair of spring-biased arms 16 extending upwardly from within the housing 14. Free upper ends 18 of the arms 16 have pads 20 disposed thereon for securement to a door jamb 100. The pads 20 are pivotally coupled with the free upper ends 18 so as to allow for adjustment to compensate for uneven surfaces. Lower ends 22 of the arms 16 have a spring 24 disposed therebetween for biasing the free upper ends 18 together. A U-shaped ring 26 extends downwardly from the housing 14. The U-shaped ring 26 has an upper safety latch 28 disposed thereon.

Next, the device 10 includes a pair of springs 32 each having upper ends 34 and lower ends 36. The upper ends 34 of the springs 32 are secured to a hook 38. The hook 38 is secured to the upper safety latch 28 of the door attachment portion 12. The lower ends 36 of the springs 32 have a hook 40 disposed therebetween. The hook 40 has a lower safety latch 42 coupled thereto. The springs 32 allow for the device 10 to swing as well as bounce up and down.

The device 10 also includes a hammock 46 comprised of a sheet of flexible material. The sheet of flexible material is sewn into a triangular configuration and secured to the lower safety latch 42 of the pair of springs 32. The sheet of flexible material has a neck roll 48 removably secured to an upper surface thereof.

The neck roll 48 includes a strip of hook and loop material 50 disposed thereon and a corresponding hook and loop strip 52 disposed on the upper surface of the hammock 46 to facilitate securement of the neck roll 48 thereto. The hammock 46 is dimensioned for receiving an infant therein. The infant, as illustrated in FIG. 1, preferably weighs less than twenty-five pounds.

Lastly, the device 10 includes a separator board 56 comprised of an elongated and planar member. The separator board 56 has a shaft 58 extending upwardly from a central portion thereof. A free end of the shaft 58 has a hook 60 disposed thereon. The hook 60 is securable to the lower safety latch 42. End portions of the separator board 56 have arcuate recesses 62 formed therein for receiving the sheet of flexible material therewithin. The separator board 56 serves to maintain the sheet of flexible material in an open configuration. This allows the baby to be comfortably positioned within the hammock 46.

Each component of the device 10 can be easily separated to allow for the easy storage within a small pouch. This will also facilitate the transportation of the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention.

What is claimed as being new and desired to be protected by LETTERS PATENT of the United States is as follows:

1. A portable baby sleeping swing for attaching to a doorway for a baby to sleep in comprising, in combination:

a door attachment portion including a housing having a pair of spring-biased arms extending upwardly from within the housing, free upper ends of the arms having pads disposed thereon for securement to a door jamb, lower ends of the arms having a spring disposed therebetween for biasing the free upper ends together, a U-shaped ring extending downwardly from the housing, the U-shaped ring having an upper safety latch disposed thereon;

a pair of springs each having upper ends and lower ends, the upper ends of the springs secured to a hook, the hook secured to the upper safety latch of the door attachment portion, the lower ends of the springs having a hook disposed therebetween, the hook having a lower safety latch coupled thereto;

a hammock comprised of a sheet of flexible material, the sheet of flexible material is sewn into a triangular configuration and secured to the lower safety latch of the pair of springs, the sheet of flexible material having a neck roll removably secured to an upper surface thereof; and a separator board comprised of an elongated and planar member, the separator board having a shaft extending upwardly from a central portion thereof, a free end of the shaft having a hook disposed thereon, the hook securable to the lower safety latch, end portions of the separator board having arcuate recesses formed therein for receiving the sheet of flexible material therewithin, the separator board serving to maintain the sheet of flexible material in an open configuration.

2. A portable baby sleeping swing comprising:

a door attachment portion adapted for securement to a door jamb;

a pair of springs each having upper ends and lower ends, the upper ends of the springs secured to a hook, the hook secured to the door attachment portion, the lower ends of the springs having a hook disposed therebetween;

hammock secured to the hook on the lower ends of the pair of springs;

a separator board serving to maintain the sheet of flexible material in an open configuration, the separator board comprised of an elongated and planar member, the separator board having a shaft extending upwardly from a central portion thereof, a free end of the shaft having a hook disposed thereon, the hook securable to the hook on the lower ends of the springs, end portions of the separator board having arcuate recesses formed therein for receiving the sheet of flexible material therewithin.

3. The portable baby sleeping swing as set forth in claim 2 wherein the door attachment portion including a housing having a pair of spring-biased arms extending upwardly from within the housing, free upper ends of the arms having pads disposed thereon for securement to the door jamb, lower ends of the arms having a spring disposed therebetween for biasing the free upper ends together, a U-shaped ring extending downwardly from the housing, the U-shaped ring having an upper safety latch disposed thereon for securement to the hook on the upper ends of the pair of springs.

4. The portable baby sleeping swing as set forth in claim 2 wherein the hammock is comprised of a sheet of flexible material, the sheet of flexible material is sewn into a triangular configuration and secured to a lower safety latch on the lower ends of the pair of springs.

5. The portable baby sleeping swing as set forth in claim 4 wherein the sheet of flexible material having a neck roll removably secured to an upper surface thereof.

* * * * *